US011254538B2

(12) United States Patent
Hansen

(10) Patent No.: US 11,254,538 B2
(45) Date of Patent: Feb. 22, 2022

(54) TEXTILE MACHINE PRODUCING TAKE-UP PACKAGES AND METHOD OF OPERATING SUCH A MACHINE

(71) Applicant: Saurer Spinning Solutions GmbH & Co. KG, Uebach-Palenberg (DE)

(72) Inventor: Bodo Hansen, Erkelenz (DE)

(73) Assignee: Saurer Spinning Solutions GmbH & Co. KG, Uebach-Palenberg (DE)

( * ) Notice: Subject to any disclaimer, the term of this patent is extended or adjusted under 35 U.S.C. 154(b) by 0 days.

(21) Appl. No.: 16/233,277

(22) Filed: Dec. 27, 2018

(65) Prior Publication Data

US 2019/0210831 A1 Jul. 11, 2019

(30) Foreign Application Priority Data

Jan. 5, 2018 (DE) ..... 10 2018 100 183.5

(51) Int. Cl.

| | |
|---|---|
| ***B65H 63/08*** | (2006.01) |
| ***B65H 67/04*** | (2006.01) |
| ***D01H 9/18*** | (2006.01) |
| ***B65H 67/06*** | (2006.01) |

(52) U.S. Cl.

CPC ..... *B65H 67/0411* (2013.01); *B65H 63/084* (2013.01); *B65H 67/0417* (2013.01); *B65H 67/064* (2013.01); *D01H 9/18* (2013.01); *B65H 2701/31* (2013.01)

(58) Field of Classification Search

CPC .... B65H 63/08; B65H 63/084; B65H 67/064; D01H 9/18; G01G 19/393; G01G 19/387

See application file for complete search history.

(56) References Cited

U.S. PATENT DOCUMENTS

| | | | | |
|---|---|---|---|---|
| 3,506,106 A * | 4/1970 | Brouwer | ..... | B65H 67/06 198/443 |
| 3,974,888 A * | 8/1976 | Murakami | ..... | G01G 13/00 177/52 |
| 2015/0175383 A1* | 6/2015 | Seifert | ..... | B65H 54/02 242/389 |

* cited by examiner

*Primary Examiner* — Timothy R Waggoner

(74) *Attorney, Agent, or Firm* — Nelson Mullins Riley & Scarborough LLP

(57) ABSTRACT

A textile machine producing take-up packages, comprising a storage area for wound take-up packages, a detecting element for measuring the weight of each take-up package to be placed on the tray, a summing element for adding up the measured weights of the take-up packages to be placed on the storage area, and an output element for outputting an output signal if the sum of the measured weights of the take-up packages exceeds a predefined threshold value.

12 Claims, 1 Drawing Sheet

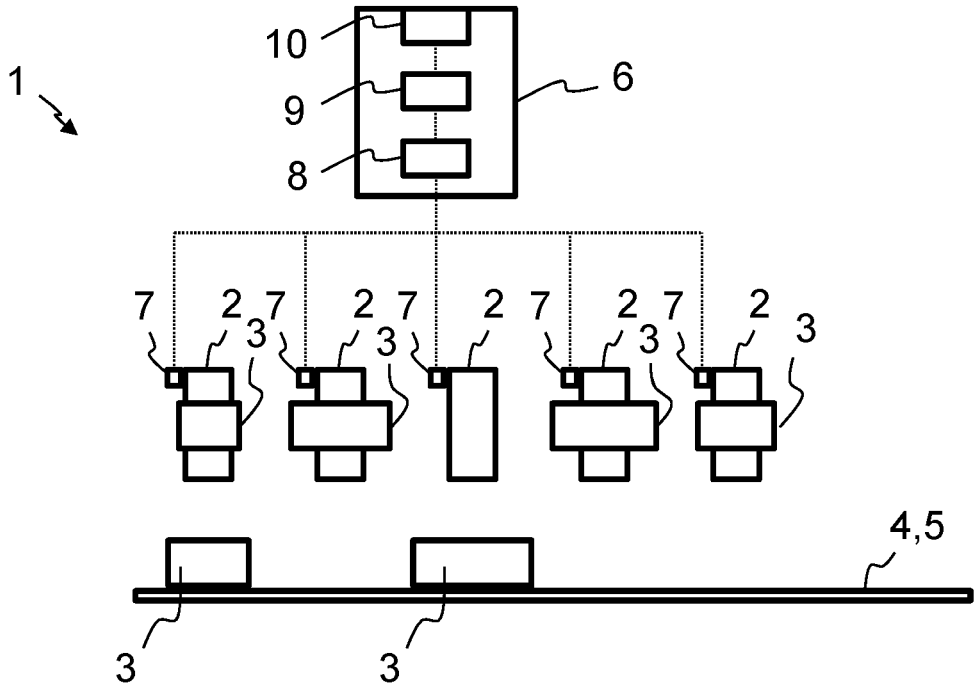
1
10
9
8
6
7
2
3
4,5

TEXTILE MACHINE PRODUCING TAKE-UP PACKAGES AND METHOD OF OPERATING SUCH A MACHINE

CROSS-REFERENCE TO RELATED APPLICATIONS

This application claims the benefit of German patent application DE 10 2018 100 183.5, filed Jan. 5, 2018, herein incorporated by reference in its entirety.

FIELD OF THE INVENTION

The present invention generally relates to textile machines producing take-up packages.

BACKGROUND OF THE INVENTION

Methods have already been disclosed for winding yarns onto take-up packages or rewinding yarns from one feed package to another take-up package after their production. Various methods and textile machines producing take-up packages have been disclosed for this purpose. However, these often have the disadvantage that removal of the wound take-up packages is inefficient.

SUMMARY OF THE INVENTION

This invention concerns a textile machine producing take-up packages, comprising a storage area for wound take-up packages, a detecting element for measuring the weight of each take-up package to be placed on the storage area, a summing element for adding up the measured weights of the take-up packages to be placed on the storage area, and an output element for outputting an output signal if the total of the measured weights of the take-up packages exceeds a predefined threshold value.

Furthermore, the present invention concerns a method for operating a textile machine producing take-up packages with a storage area for wound take-up packages, in which case the method comprises the steps of: detecting the weight of each take-up package to be placed on the storage area, and adding up the detected weights of the take-up packages to be placed on the storage area, and outputting an output signal if the total of the detected weights of the take-up packages exceeds a predefined threshold value.

BRIEF DESCRIPTION OF THE DRAWINGS

The present invention will become more fully understood from the detailed description and the accompanying drawings, which are not necessarily to scale, wherein:

FIG. 1 shows a schematic representation of a textile machine producing take-up packages.

DESCRIPTION OF THE PREFERRED EMBODIMENTS

A textile machine producing take-up packages and a method for operating a textile machine producing take-up packages are described, in which wound take-up packages are grouped or combined into lots particularly efficiently. The described method is preferably carried out with the described textile machine producing take-up packages. The textile machine producing the described take-up packages is preferably operated according to the described method.

FIG. 1 shows a textile machine 1 producing take-up packages. The textile machine 1 producing take-up packages is preferably designed and equipped to wind yarns onto take-up packages 3. Textile yarns are particularly suitable as yarns. With the textile machine 1 producing take-up packages, the yarns can be wound onto the take-up packages 3 immediately after they have been manufactured or after processing of the yarns or from feed packages.

For winding onto the take-up packages 3, the textile machine 1 producing take-up packages preferably has at least one workstation with a winding device 2. In the example of FIG. 1, five winding devices 2 are shown. However, it is also possible that the textile machine 1 producing take-up packages has a much larger number of workstations with winding devices 2. For example, the textile machine 1 producing take-up packages can have 480 or even 720 workstations with winding devices 2. A take-up package 3 can be wound on a winding device 2. As soon as the take-up package 3 is fully wound, the take-up package 3 can be removed from winding device 2 and another take-up package 3 can be wound in the winding device 2.

During the procedure of winding the yarn onto the take-up package 3, for example, a yarn of a predetermined length can be wound onto the take-up package 3. Alternatively, a yarn with a predetermined weight can be applied to the take-up package 3 so that a take-up package 3 is wound (and finished) when the wound yarn has the predetermined length or weight. Typically, such fully wound take-up packages 3 are then not transported individually, but in lots, from the textile machine 1 producing the take-up packages for further processing. For this purpose, the finished take-up packages 3 are collected on a storage area 4 of the textile machine producing take-up packages and then transported away when the lot is complete.

The fully wound take-up packages 3 can be placed on a storage area 4 of the textile machine 1 producing take-up packages. For this purpose, the textile machine 1 producing take-up packages either has a corresponding device for ejecting the take-up package 3 on each winding device 2 or a service unit transfers the take-up package 3 to the storage area 4 before an empty tube is inserted, which is then wound into a take-up package 3. The storage area 4 is preferably designed and equipped to receive the wound take-up packages 3 from the winding devices 2. Preferably, the storage area 4 is designed as a conveyor belt 5 as shown in the example in FIG. 1. The conveyor belt 5 is preferably at a standstill in its basic condition. As soon as the conveyor belt 5 is fully loaded, the conveyor belt 5 is preferably started so that all the wound take-up packages 3 on the conveyor belt 5 at that time can be removed with the conveyor belt 5. As soon as all the wound take-up packages 3 on the conveyor belt 5 have been removed, the conveyor belt 5 is preferably switched off again, so that the conveyor belt 5 comes to a standstill again. The conveyor belt 5 can then be loaded again until it is restarted when fully loaded.

In the example of FIG. 1, the take-up packages 3 shown in the winding devices 2 are wound to different extents. This is indicated by the different extent of the take-up packages 3 in a right-left direction as shown in FIG. 1. The middle winding device 2 is shown in a situation in which a take-up package change has just taken place. This means that the take-up package 3 is placed on the conveyor belt 5 and winding of an empty tube into a new take-up package 3 in the winding device 2 has not yet started. A take-up package change has also taken place in the winding device 2 on the far left, so that one wound take-up package 3 lies below the winding device 2 on the conveyor belt 5, while a new take-up package 3 has already started to be wound. Furthermore, it can be seen that the take-up packages 3 placed on the conveyor belt 5 have different extents. This is intended to indicate that yarns of different lengths can be wound onto the different take-up packages 3. In a production process, each take-up package 3 can be wound with a yarn of different lengths. Alternatively, in a first production process, each take-up package 3 can be wound with a yarn of a first yarn length, while in a second production process, each take-up package 3 is wound with a yarn of a second yarn length differing from the first yarn length.

The removal of the loaded take-up packages 3 is particularly efficient if the conveyor belt 5 is always started exactly when fully loaded. If the conveyor belt 5 is started beforehand, it is transported away more times than necessary. The complete loading of conveyor belt 5 can be defined in particular by the weights of the take-up packages 3 on conveyor belt 5. In particular, conveyor belt 5 can be considered fully loaded if a maximum permissible weight of the take-up packages 3 on conveyor belt 5 at the same time exceeds a predefined threshold value. For example, the maximum authorized weight can be 1200 kg.

In one embodiment, the storage area 4 is designed as a conveyor belt 5. Alternatively, storage area 4 can, for example, comprise containers into which the wound take-up packages 3 are placed. As soon as a container has been completely loaded with wound take-up packages 3, the container can be transported away. In this case too, the complete loading can be defined by the total weight of the take-up packages 3 in the container.

It would be conceivable to determine the complete loading of the storage area 4 by assuming all take-up packages 3 have the same weight and thus ascertaining a permissible number of take-up packages 3 from the maximum permissible weight. As soon as the permissible number of take-up packages 3 on the storage area 4 is reached, they can be transported away. However, such a procedure can be inefficient especially if the take-up packages have 3 different weights. If some of the take-up packages 3 are lighter than the assumed weight, the maximum permissible weight might still not be reached even when the permissible number of take-up packages 3 is reached. If a smaller value were assumed for the weight of the take-up packages 3, there would be a risk that the maximum permissible weight would be exceeded.

For example, with a maximum permissible weight of 1200 kg and an assumed weight of 5 kg for the individual take-up packages 3, the permissible number of take-up packages 3 is 240. If 240 take-up packages 3 are now placed on the conveyor belt 5, their total weight at an actual weight of 5 kg per take-up package 3 is exactly 1200 kg. However if, for example, the take-up packages 3 weigh only 4 kg each, the total weight will be only 960 kg. With a package weight of only 3 kg, the total weight will be only 720 kg. If the number of take-up packages of 240 were used as a criterion for removal, the conveyor belt 5 would be underloaded by 240 kg for the 4 kg take-up packages 3 and by 480 kg for the 3 kg take-up packages 3. Removal with an underloaded conveyor belt 5 is inefficient, of course.

With the described textile machine 1 producing take-up packages and with the described method, the complete loading of storage area 4 can be detected particularly effectively, so that the removal of the wound take-up packages 3 can be carried out particularly efficiently. For this purpose, the weights of the individual take-up packages 3 are measured using the method described.

If the maximum permissible weight is 1200 kg, this means it is possible for 240 take-up packages 3 with 5 kg weight each, 300 take-up packages 3 with 4 kg weight each or 400 take-up packages 3 with 3 kg weight each to be placed on the conveyor belt 5. In all cases, the maximum permissible weight is fully utilized. The described method thus offers the advantage of a weight totaling of each take-up package 3 in comparison to simply counting the take-up packages, especially for lighter take-up packages.

The weight of the take-up package 3 is preferably measured before the take-up package 3 is placed on the storage area 4. This is preferably done in such a way that the respective weight of at least one of the take-up packages 3 is measured based on a length of a yarn wound onto the take-up package 3. Preferably, the weight is measured in this way for each of the take-up packages 3. In particular, the weight of the yarn wound onto the take-up package 3 can be calculated from its length. Then an empty weight of the take-up package 3 or the empty tube can be added to obtain the weight of the take-up package 3. The length of the yarns can be measured, in particular as shown in the example in FIG. 1, via a corresponding yarn length detector 7 on each of the winding devices 2. The weight of the take-up packages 3 can be measured from the length of the wound yarn, in particular with a detecting element 8 which can be provided, for example, in a control unit 6 as shown in FIG. 1. The detecting element 8 can be designed as hardware and/or implemented as software in control unit 6. The yarn length detectors 7 are preferably connected to the control unit 6 or to the detecting element 8. The length of the yarns can be output from the yarn length detector 7, for example, via a signal to the detecting element 8 and converted by the detecting element 8 into a weight of the respective take-up package 3. It is possible for a single detecting element 8 to be provided for measuring the weights of all take-up packages 3. However, it is also possible for several detecting elements 8 to be provided, each of which is assigned to a group of winding devices 2. Each winding device 2 can also have a corresponding detecting element 8 from which the weight of the take-up package 3 can be transferred to the control unit 6 via a corresponding signal. In particular, it is possible for the detecting elements 8 to be integrated into the service unit so that the weight of the take-up package 3 is output by the service unit as a signal to the control unit 6, especially during a placement process. The weight of the take-up packages 3 can be transferred in particular via a signal, for example in the form of a telegram.

Measuring the weights of the take-up packages 3 by means of the length of the wound yarns is preferred, but not necessary. Alternatively or additionally, it is possible for the respective weight of at least one of the take-up packages 3 to be ascertained by measurement. This can be done in particular by a weight sensor which is arranged in the respective winding device 2 in such a way that the weight of the take-up package 3 can be ascertained by measurement already during winding and/or immediately after winding. The weight sensor can be integrated in the service unit in particular.

After the weights of the individual take-up packages 3 have been measured, they are added up in the described method. The textile machine 1 producing the described take-up packages has a summing element 9 for this purpose. The summing element 9 can be provided in the control unit 6 in particular, as shown in the example in FIG. 1. In particular, summing element 9 can be implemented as hardware and/or software. The weights of the take-up packages 3 which are in the storage area 4 at the same are preferably added together. Thus, the result of the adding up is the total weight of all take-up packages 3 which are in the try 4 at the same time. This is the parameter to be compared with the maximum permissible weight of the take-up packages 3 on the storage area 4 at the same time. After the take-up packages 3 have been removed, the calculation of the sum is preferably reset. This means that the calculation of the sum starts again from zero, for example after a removal of the take-up packages 3 by the conveyor belt 5 starting. This takes account of the fact that only the total weight of take-up packages 3 on the conveyor belt 5 at the same time must be below the permissible total weight of take-up packages 3 on conveyor belt 5 at the same time. The weights of the take-up packages 3 which have already been removed and which are no longer on the conveyor belt 5 are irrelevant.

On the basis of the sum of the weights of the take-up packages 3, it is possible to decide in particular when the storage area 4 is to be regarded as completely loaded. Thus, an output signal is output if the total of the measured weights of the take-up packages 3 exceeds a predefined threshold value. In particular, the predefined threshold value can be the maximum permissible weight of the take-up packages 3 on the storage area 4 or conveyor belt 5 at the same time. As soon as this threshold value is reached, the take-up packages 3 are preferably transported away, i.e. the storage area 4 is emptied. It is permissible for the maximum permissible weight to be exceeded by a tolerance value. For example, it is assumed that the maximum permitted weight is 1200 kg, in which case the predefined threshold value is selected as 1200 kg. If there are now take-up packages 3 with a total weight of 1199 kg on the conveyor belt 5, no output signal will be output. When a take-up package 3 with a weight of 5 kg is placed, the total weight increases to 1204 kg and thus exceeds the maximum permissible weight. However, such an excess can be accepted within a tolerance of, for example, 5% of the maximum permissible weight. The tolerance range can also be set in such a way that several take-up packages 3 can be placed on the conveyor belt 5 at the same time. Thus, the total weight of 1199 kg can increase to 1209 kg if two take-up packages 3 with a weight of 5 kg each are placed at the same time. Alternatively, the predefined threshold value can be selected below the maximum permissible weight in such a way that it is highly unlikely that the maximum permissible weight will ever be exceeded.

The output signal can be output by an output element 10 in particular. The output element 10 can be provided in the control unit 6 in particular, as shown in the example in FIG. 1. In particular, the output element 10 can be implemented as hardware and/or software.

If the output signal is output, the storage area 4 is preferably emptied. If the storage area 4 is designed as a conveyor belt 5, this is preferably done by starting the conveyor belt 5 after the output signal for the removal of the take-up packages 3 placed on it. The take-up packages 3 can then be transported by the conveyor belt 5 to a storage area, for example, where the take-up packages 3 are removed from the conveyor belt 5.

For example, the output signal can be output as a signal for a user of the textile machine 1 producing the take-up packages, especially optically and/or acoustically. The user can then manually initiate the removal of the take-up packages 3, for example by starting the conveyor belt 5 via a start button. Alternatively, the output signal can be further processed digitally. For example, conveyor belt 5 can be started automatically by the output signal.

Furthermore, it is preferred that when the output signal is output or when the predefined threshold value is exceeded, further take-up packages 3 are not placed on the storage area 4 or on the conveyor belt 5. For this purpose, the devices for ejecting the take-up package 3 of the winding devices 2 in particular or the service units can be blocked so that no further take-up packages 3 are placed on the storage area 4 or on the conveyor belt 5. The devices or service units are preferably released again when the removal of the take-up packages 3 from the storage area 4 or using the conveyor belt 5 has been completed.

The described method can be summarized as follows. After a device or service unit has placed a take-up package 3, the service unit not only notifies the control unit 6 that the placement cycle has finished, but also the weight of the placed take-up package 3, preferably via a telegram. If, after X placement cycles and X addings up, the total weight of all take-up packages 3 reaches the predefined threshold of, for example, 1200 kg, the output signal issues a prompt for a clearing operation to be carried out. The advantage of the described method is that the limit is not a predetermined number of take-up packages, but the actual weight of the take-up packages 3.

LIST OF REFERENCE NUMBERS

1 Textile machine producing take-up packages
2 Winding device
3 Take-up package
4 Storage Area
5 Conveyor belt
6 Control unit
7 Yarn length detector
8 Detecting element
9 Summing Element
10 Output element It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A textile machine producing take-up packages, comprising:

a multitude of workstations with winding devices, on which winding devices take-up packages are wound, a storage area of the textile machine for wound take-up packages, which storage area is designed and equipped to receive the wound take-up packages from the winding devices, a detecting element for detecting the weight of each take-up package to be placed on the storage area before the take-up package is placed on the storage area, a summing element for adding up the measured weights of the take-up packages to be placed on the storage area, and an output element for outputting an output signal if the sum of the detected weights of the take-up packages exceeds a predefined threshold value.

2. The textile machine producing take-up packages according claim 1, in which a corresponding yarn length detector is connected to the detecting element for at least one winding device of the textile machine producing take-up packages.

3. The textile machine producing take-up packages according to claim 1, wherein an empty weight of the take-up package or an empty tube is added to obtain the weight of the take-up package.

4. The textile machine producing take-up packages according to claim 2, wherein the yarn length detector outputs the length of the yarns via a signal to the detecting element and the detecting element converts the signal into the weight of each respective take-up package.

5. A method for operating a textile machine producing take-up packages with a multitude of workstations with winding devices and a storage area for wound take-up packages, which storage area is designed and equipped to receive the wound take-up packages from the winding devices, the method comprising:

winding take-up packages on the winding devices, detecting the weight of each take-up package to be placed on the storage area before the take-up package is placed on the storage area, adding up the detected weights of the take-up packages to be placed on the storage area, and outputting an output signal if the sum of the detected weights of the take-up packages exceeds a predefined threshold value.

6. The method according to claim 5, in which the respective weight of at least one of the take-up packages is detected before the take-up package is placed on the storage area.

7. The method according to claim 5, in which the respective weight of at least one of the take-up packages is detected by measurement.

8. The method according to claim 5, in which the respective weight of at least one of the take-up packages is detected based on a length of a yarn wound onto the take-up package.

9. The method according to claim 5, in which the storage area is constructed as a conveyor belt which is started after output of the output signal for transporting the take-up packages placed on it.

10. A control unit designed and arranged to carry out a method according to claim 5.

11. A computer program intended and adapted to carry out a method according to claim 5.

12. A machine-readable storage medium on which the computer program according to claim 11 is stored.

* * * * *